US005957540A

United States Patent [19]

Tremblay

[11] Patent Number: 5,957,540

[45] Date of Patent: Sep. 28, 1999

[54] BLASTING POSITIONING DEVICE

[75] Inventor: Claude Tremblay, Malartic, Canada

[73] Assignee: BL-STAR Industries Inc., Quebec, Canada

[21] Appl. No.: 08/840,958

[22] Filed: Apr. 21, 1997

[30] Foreign Application Priority Data

Oct. 21, 1996 [CA] Canada ..... 2188336

[51] Int. Cl.[6] ..... F42D 1/22

[52] U.S. Cl. ..... 299/13; 102/313; 102/321

[58] Field of Search ..... 299/13; 102/313, 102/321; 86/20.15; 89/1.34

[56] References Cited

U.S. PATENT DOCUMENTS

| | | | |
|---|---|---|---|
| 1,600,940 | 9/1926 | Hennen | 102/313 |
| 3,342,130 | 9/1967 | Miller et al. | 181/116 |
| 4,522,129 | 6/1985 | Jerberyd | 299/13 X |
| 5,233,926 | 8/1993 | Carmichael et al. | 102/302 |

FOREIGN PATENT DOCUMENTS 2018540 7/1993 Canada .

OTHER PUBLICATIONS

XP–002059300, Soviet Inventions Illustrated, Section PQ, Week 7908, Feb. 27, 1980, Derwent Publications Ltd., London, GB.

XP–002059301, Soviet Inventions Illustrated, Section PQ, Week 8003, Apr. 4, 1979, Derwent Publications Ltd., London, GB.

XP–002059302, Soviet Patent Abstracts, Section PQ, Week 8731, Aug. 12, 1987, Derwent Publications Ltd., London, GB.

*Primary Examiner*—David J. Bagnell

*Attorney, Agent, or Firm*—Greer, Burns & Crain. Ltd.

[57] ABSTRACT

A device for unblocking mine raises which has multiple flexible arms attached to a top hollow tube which carries the explosive material. Flexible extension poles are attached to a top hollow tube section and hollow tube sections. The flexible arms allow for easy, precise and safe positioning of the explosive material.

8 Claims, 3 Drawing Sheets

BLASTING POSITIONING DEVICE

The present invention relates to a device made for positioning explosive material.

BACKGROUND Of THE INVENTION

This invention relates to a blasting positioning device for unblocking mine draw points, ore passes, backfill raises or any other near vertical raises, where rock or other free falling material may get blocked during use.

Mine draw points, ore passes, backfill raises or any other near vertical raises often get blocked during use and it is often difficult and unsafe to unblock them. It is highly unsafe for a miner to work in a blocked area and more particularly underneath that area.

It is common in the mining industry to unblock such a blocked area by attaching explosive material at the upper end of a string of poles, bracing the lower end of the string at the base of the area and thereafter igniting the explosive material to blast and displace the material blocking the area.

It is also common in the mining industry to unblock a blocked area using a device which is propelled by air whereby the device, to which explosive material is attached, is positioned by feeding pressurized air into the air chamber of such device.

However, the above techniques of getting the blasting device in position are either dangerous, do not get the explosive material exactly where it should go, are difficult to control, are expensive to operate and breakage may take place at times. Furthermore, working in the area immediately adjacent to the base of a blocked area is generally very dangerous and therefore some blocked areas may never be unblocked, or only partially, resulting in great losses to mining authorities.

SUMMARY OF THE INVENTION

The present invention overcomes the above shortcomings.

It is an object of the present invention to provide a device for unblocking areas which presents a minimum of exposure for the miners operating such device, and at minimal costs to the mining authorities.

In accordance with another object of the present invention there is provided a device which can be securely and precisely positioned in order to ensure that the best possible results are achieved.

In accordance with yet another object of the present invention there is provided a blasting positioning device for unblocking blocked areas, which comprises: a) a top hollow tube section and hollow tube sections into which can be inserted and secured flexible extension poles; b) flexible arms; c) means for attaching said flexible arms to said top hollow tube section; and d) an ignition line connected to an explosive material for igniting from a distance; whereby the explosive material attached to the top hollow tube section is positioned in the blocked area before blasting.

Further objects and advantages of the present invention will be apparent from the following description, wherein preferred embodiments of the invention are clearly shown.

BRIEF DESCRIPTION OF THE DRAWINGS

The present invention will be further understood from the following description with reference to the drawings in which.

DETAILED DESCRIPTION OF THE INVENTION

Figure 1:
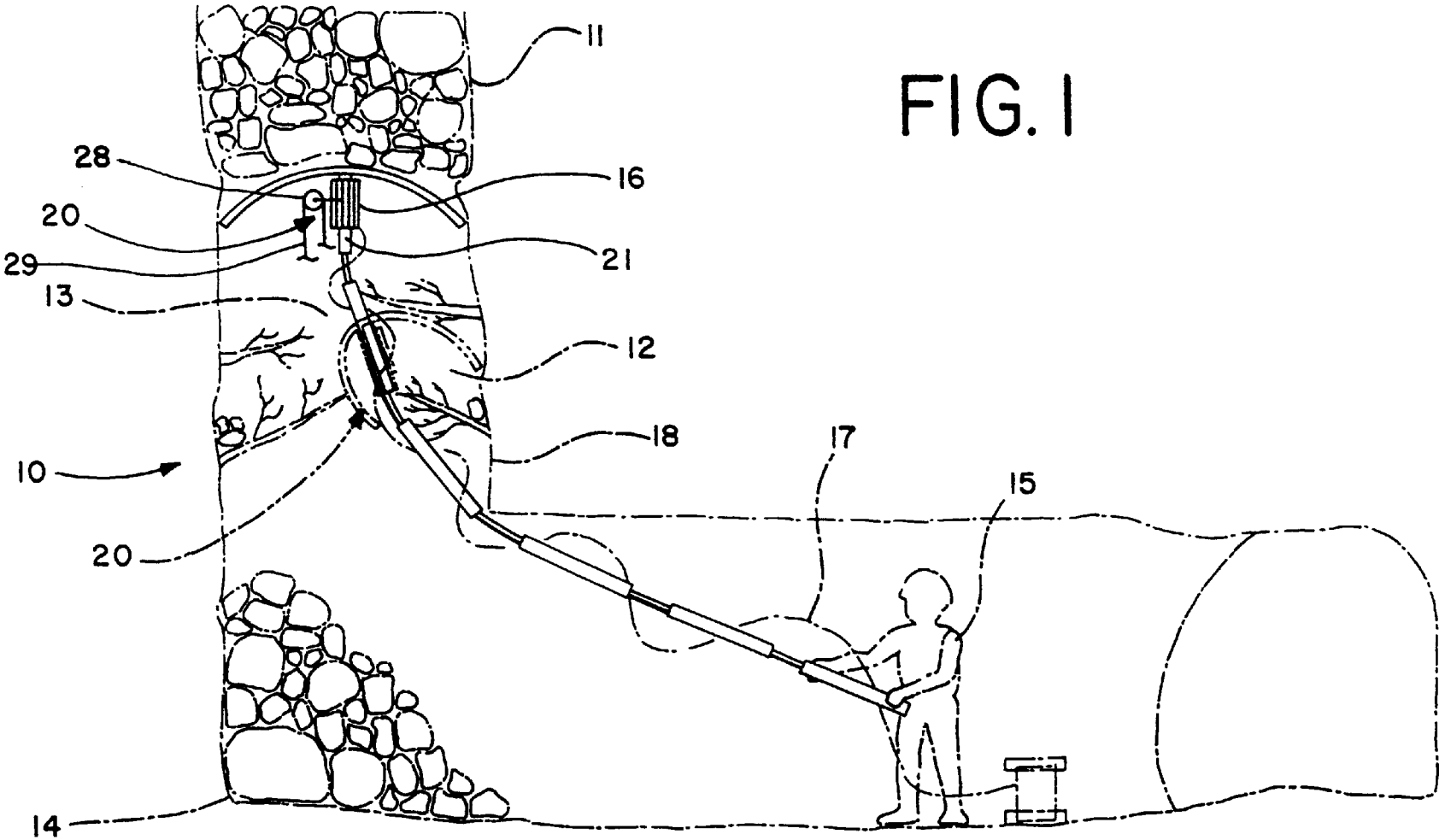
FIG. 1 is a diagram showing a blocked vertical raise with the blasting positioning device in place.

Referring to FIG. 1, there is shown a diagram of an underground raise 10 having rocks, and other materials, blocking area 11, with at an intermediate level 12 further debris showing a narrow opening 13. In order to loosen the blocked area 11, and therefore make all debris fall to ground level 14, a blasting positioning device 20 is pushed upwards along the walls 18 and through opening 13 of the underground raise 10, under the thrust of the miner 15 operating the device 20. Attached to an explosive material 16, which is secured to a top hollow tube section 21, is an ignition line 17 which runs down to the miner 15 in order to be able to ignite the explosive material from a safe distance.

Figure 2:
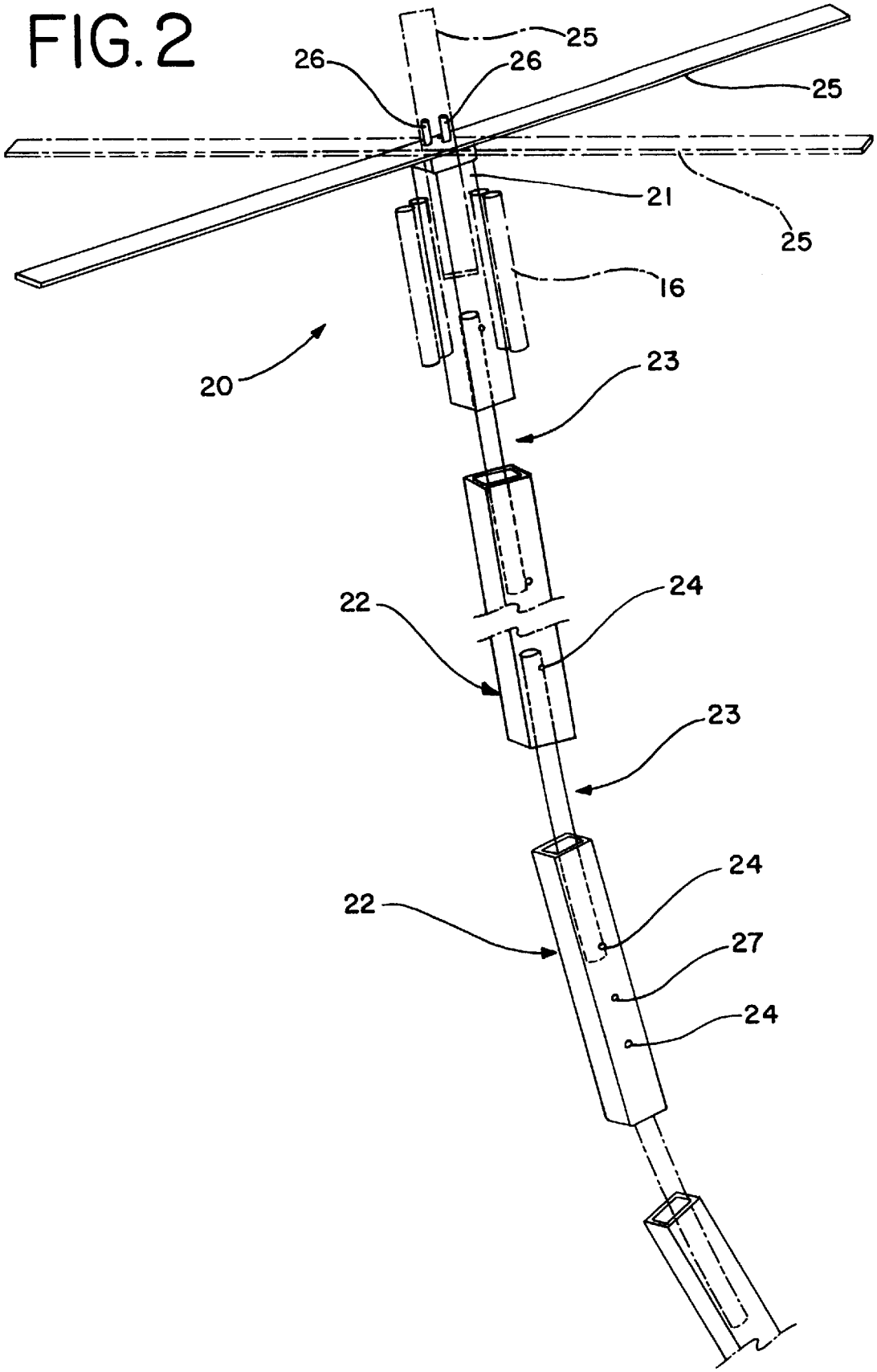
FIG. 2 is a perspective view of the device.

Referring to FIG. 2, there is shown a blasting positioning device 20 with a top hollow tube section 21 and multiple hollow tube sections 22, to which can be attached flexible extension poles 23. It should be noted that the poles 23 can easily be fitted into place with the help of a stop member 27 generally located at the middle parts of the top hollow tube section 21 and the hollow tube sections 22. The poles 23 can be securely attached to the top hollow tube section 21 and sections 22 by means of screws through openings 24 or can be telescopically inserted into said top hollow tube section 21 and sections 22. It should be noted that the top hollow tube section 21, the hollow tube sections 22 and the flexible extension poles 23 are made of flexible material, such as light and strong but flexible plastic, or even wood for instance in the case of the flexible extension poles 23, without limiting the type of material that can be used, in order to be able to position the device 20 in the best possible manner and therefore obtaining the best possible results, at low cost to the mining authorities.

Further referring to FIG. 2, there is shown multiple flexible arms 25 which arms 25 are attached 26 and equally spaced, by means of screws and bolts for instance, to the top hollow tube section 21 in a star-like pattern in order to cover and protect all sides of the device 20 The flexible arms 25 by extending away from the centre of the top hollow tube section 21 allow for the device 20 to make it through narrow opening 13 and along the walls 18, thereby keeping the explosive material 16 from getting displaced and/or wrecked. Also the use of the flexible arms 25 ensure that the device 20 is positioned at the highest possible point of the blocked underground raise 10 since they offer the facility of getting through partially blocked areas, such as area 13 for instance. The flexible arms 25 can be made of polycarbonate, for instance, which offers maximum flexibility and is yet light and strong, or any other flexible but strong material. In illustrating the invention, three flexible arms 25 were used, three being a number suited for ideally positioning and protecting all sides of the device 20 at a minimum cost to the mining authorities. It should also be noted that the length of the flexible arms 25 can be adjusted in order to best serve the needs of the miner operating the device 20, all depending on the area to be covered.

Also, it is possible to attach a pulley 28 to the top hollow tube section 21, which pulley 28 can be used in connection with a cable 29, which is attached before the miner starts pushing the device 20 up the raise 10, in order to get larger loads, be it of explosive material 16 or others, up the device 20 once it is positioned.

Figure 3:
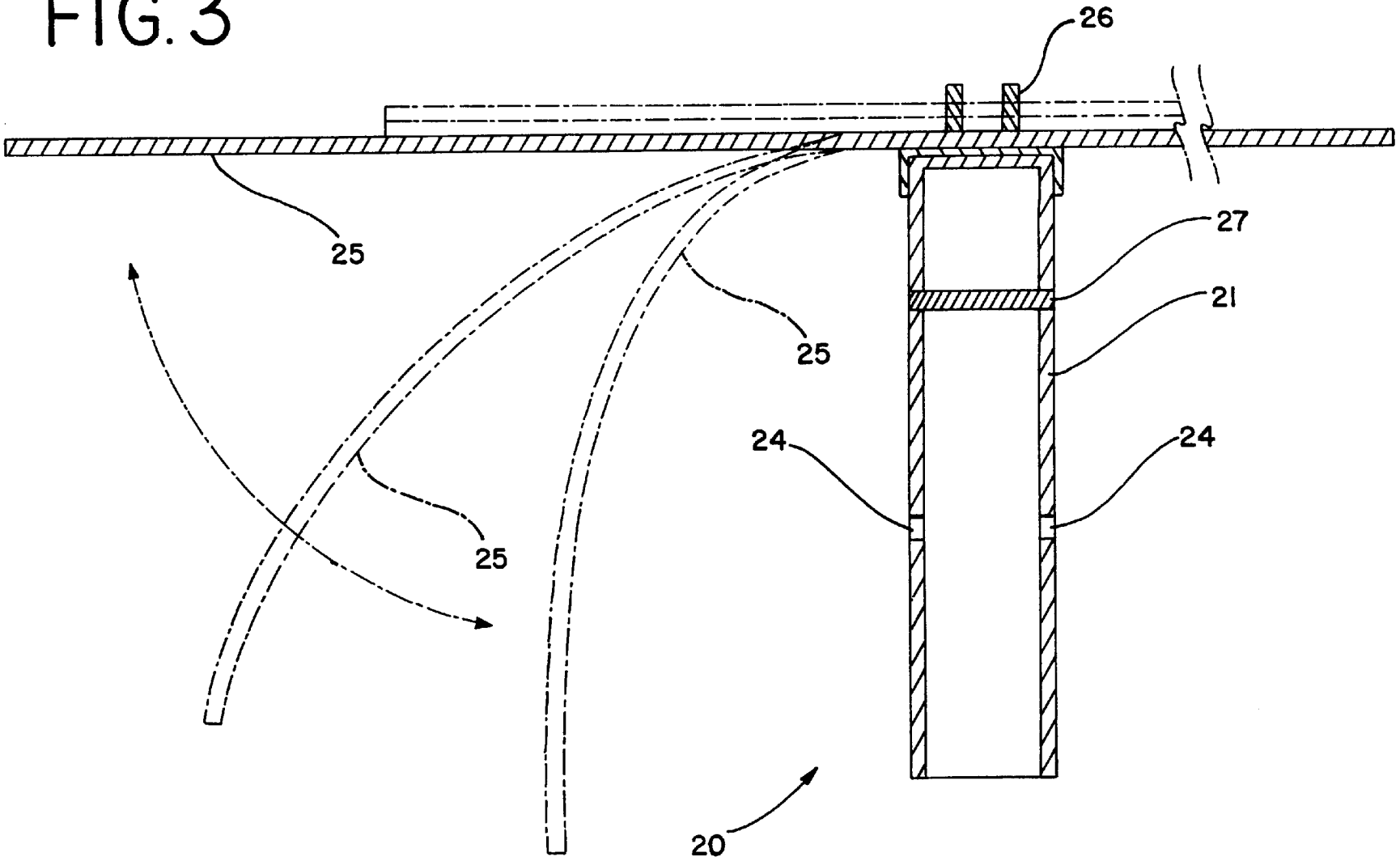
FIG. 3 is a cross-sectional view of the device in accordance with the present invention.

Referring to FIG. 3, there is shown the top hollow tube section 21 and the attached multiple flexible arms 25, thereby illustrating the flexibility that can be achieved and the stability resulting from it in the positioning of the device 20.

A device 20 that is operable even when constructed from lightweight material has the advantages that it can be portable, is easily stored and does not cost much to manufacture. The fact that it also comes in sections allows for adjusting to the height needed to best position the device 20 in a safe and cost efficient manner.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

The embodiment of the invention in which an exclusive property or privilege is claimed are defined as follows:

1. A blasting positioning device for unblocking blocked areas, which comprises:

(a) a top hollow tube section and hollow tube sections into which can be inserted and secured flexible extension poles;

(b) flexible arms;

(c) means for attaching said flexible arms to said top hollow tube section; and (d) an ignition line connected to an explosive material for igniting from a distance; whereby the explosive material attached to the top hollow tube section is positioned in the blocked area before blasting.

2. A device as claimed in claim 1 wherein the flexible arms are made of flexible material comprising polycarbonate.

3. A device as claimed in claim 1 wherein the top hollow tube section and the hollow tube sections are fitted with a stop member.

4. A device as claimed in claim 1 wherein the top hollow tube section and the hollow tube sections are made of plastic.

5. A device as claimed in claim 1 wherein the extension poles are made out of flexible material comprising plastic.

6. A device as claimed in claim 1 wherein the extension poles are made of wood.

7. A device as claimed in claim 1 wherein the extension poles are telescopically attached to the top hollow tube section and the hollow tube sections.

8. A device as claimed in claim 1 wherein the top hollow tube section is fitted with a pulley.

* * * * *